US007395873B2

(12) United States Patent
Nakamura et al.

(10) Patent No.: US 7,395,873 B2
(45) Date of Patent: Jul. 8, 2008

(54) POWER TOOL

(75) Inventors: Masamichi Nakamura, Osaka (JP); Yoshikazu Okada, Shiga (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 11/494,480

(22) Filed: Jul. 28, 2006

(65) Prior Publication Data

US 2007/0023197 A1 Feb. 1, 2007

(30) Foreign Application Priority Data

Jul. 29, 2005 (JP) ..... 2005-221824

(51) Int. Cl.
*B25D 11/00* (2006.01)
*B25D 11/04* (2006.01)

(52) U.S. Cl. ..... 173/93.5; 173/170; 173/176

(58) Field of Classification Search ..... 173/217, 173/170, 176, 179; 200/43.17, 522, 321, 200/322, 430

See application file for complete search history.

(56) References Cited

U.S. PATENT DOCUMENTS 3,550,472 A 12/1970 Dummer
3,761,663 A 9/1973 Brown
4,329,555 A * 5/1982 Wied ..... 200/522
4,572,997 A * 2/1986 Yamanobe et al. ..... 388/840
5,414,793 A * 5/1995 Morikawa ..... 388/824
5,606,234 A * 2/1997 Kraenzler et al. ..... 318/543
6,218,633 B1 4/2001 Okumura et al.
6,555,773 B1 * 4/2003 Broghammer et al. ... 200/61.85
7,053,325 B2 * 5/2006 Yuasa et al. ..... 200/522

FOREIGN PATENT DOCUMENTS

JP 60 196904 10/1985
JP 06 254779 9/1994

* cited by examiner

*Primary Examiner*—Rinaldi Rada
*Assistant Examiner*—Nathaniel Chukwurah
(74) *Attorney, Agent, or Firm*—Bacon & Thomas, PLLC

(57) ABSTRACT

A power tool includes a grip portion having a vertically extending axis; a main body provided at a top end of the grip portion and having an axis intersecting the vertical axis; a motor; an output portion projecting from the grip portion and rotatingly driven by the motor; a trigger provided for movement along a trigger moving zone; a stopper portion accommodated in the grip portion for protrusion and retraction into and from the trigger moving zone, the stopper portion adapted to selectively make contact with the trigger to thereby limit the maximum pulling amount of the trigger; and a stopper operating portion for operating the stopper portion. The stopper portion is protruded into or retracted from the trigger moving zone by slidingly actuating the stopper operating portion in a crosswise direction perpendicularly intersecting the axis of the main body as viewed from the top.

7 Claims, 16 Drawing Sheets

POWER TOOL

FIELD OF THE INVENTION

The present invention relates to a power tool having a built-in speed control switch for controlling the rotation speed of a motor depending on the pulling amount of a trigger.

BACKGROUND OF THE INVENTION

Examples of power tools used in tightening bolts or screws or drilling holes include a hand-held type power tool that has a grip portion whose axis extends in an up-down direction 3nd a main body provided on the to, end of the grip portion, the main body having an axis intersecting the axis of the grip portion such that the power tool can have a generally T-shaped or L-shaped configuration as a whole. As one example of this kind of power tool, Japanese Patent Laid-open Publication No. S60-196904 ("prior art reference 1") discloses a power tool having a trigger provided on the top of a grip portion for movement along the axial direction of a body and a built-in speed control switch for controlling the rotation speed of a motor depending on the pulling amount of the trigger.

In such a power tool as disclosed in the prior art reference 1, a user should adjust the pulling amount of the trigger with a finger so as to perform a variety of tasks. For instance, if the user wishes to decrease the rotation speed of the motor, it is very difficult to stably keep the pulling amount of the trigger at, e.g., an intermediate level during the course of conducting an intended task. That is, this poses a problem in that great difficulty is encountered in constantly maintaining the rotation speed of the motor at an intermediate speed while carrying out the intended task.

Apart from the above-mentioned power tool wherein the main body is provided on the top end of the grip portion with its axis intersecting the axis of the grip portion such that the power tool can have a generally T-shaped or L-shaped configuration as a whole, Japanese Patent Laid-open Publication No. H6-254779 ("prior art reference 2") teaches a reciprocating saw that has a grasping portion, a trigger provided on the grasping portion to control the rotation speed of a motor in proportion to the pulling amount thereof and a stopper portion for retracting and protruding movement with respect to a moving zone of the trigger. In this reciprocating saw, the stopper portion can be protruded into the moving zone of the trigger through the manual actuation of an operating portion, thereby limiting the maximum rotating speed of the motor.

According to the power tool taught in the prior art reference 2, the operating portion for creating movement of the stopper portion is arranged on the top surface of the power tool independently of the grasping portion to thereby ensure that no finger reaches the operating portion when the grasping portion is gripped by a user. Providing the operating portion on the top surface of the power tool in this way, however, raises a possibility that the operating portion might be inadvertently actuated through the contact with a tool resting surface as the power tool is placed on the tool resting surface when not in use. This may sometimes change the maximum rotation speed of the motor without the user knowing of such change. Another problem is that the operating portion is vulnerable to damage when the power tool is mistakenly dropped and struck against a floor or the like.

SUMMARY OF THE INVENTION

In view of the foregoing and other problems, it is an object of the present invention to provide a power tool that can limit the pulling amount of a trigger by use of a stopper portion, thereby making it possible to change the maximum rotation speed of a motor, and can also prevent a stopper operating portion for actuation of the stopper portion from being touched by a user's finger as the user grasps a grip portion or from making contact with a tool resting surface as the power tool is placed on the tool resting surface, thus avoiding any erroneous actuation of the stopper operating portion, and further that can keep the stopper operating portion less vulnerable to damage even when the power tool is dropped inadvertently.

In accordance with the present invention, there is provided a power tool including: a grip portion having an axis extending in an up-down direction; a main body provided at a top end of the grip portion and having an axis intersecting the axis of the grip portion; a motor for generating a rotational force; an output portion provided at one axial end of the main body projecting from the grip portion and rotatingly driven by the motor; a trigger provided on an upper output-portion-side surface of the grip portion for movement along a trigger moving zone; a speed control switch received within the grip portion for controlling the rotation speed of the motor in proportion to the pulling amount of the trigger; a stopper portion accommodated in the grip portion for protrusion and retraction into and from the trigger moving zone, the stopper portion adapted to, when protruded into the trigger moving zone, make contact with the trigger to limit the maximum pulling amount of the trigger; a battery receiving portion provided at a bottom end of the grip portion and having an outside dimension greater than that of the grip portion; and a stopper operating portion provided on a top surface of the battery receiving portion for operating the stopper portion, wherein the stopper portion is protruded into or retracted from the trigger moving zone by slidingly actuating the stopper operating portion in a crosswise direction perpendicularly intersecting the axis of the main body as viewed from the top. In this way, the stopper operating portion for actuation of the stopper portion is provided on the top surface of the battery receiving portion in a spaced-apart relationship with the grip portion. This makes it difficult for the user's fingers to inadvertently touch the stopper operating portion when the grip portion is initially grasped or continues to be in a grasped condition. Furthermore, the top surface of the battery receiving portion on which the stopper operating portion is provided is so oriented as to face the main body. Thus, it is hard for the stopper operating portion to make contact with a tool resting surface even if the power tool is placed on the tool resting surface when not in use. This helps to avoid any erroneous actuation of the stopper operating portion. Moreover, even when the power tool is dropped on a floor inadvertently, the stopper operating portion can hardly make contact with the floor and thus the stopper operating portion is prevented from any damage. In addition, when firmly grasping the grip portion, the little finger of the user's hand moves in the front-rear direction and not in the crosswise direction in which the stopper operating portion is actuated. For this reason, the stopper operating portion is kept stationary even in a hypothetical case that the user's hand makes contact with the stopper operating portion during the course of its movement in the front-rear direction. This prevents the stopper operating portion from being erroneously actuated by the little finger of the user's hand at the time of firmly grasping the grip portion.

It is preferred that, upon actuation of the stopper operating portion in the crosswise direction, the stopper portion is moved in the up-down direction between the trigger moving zone and a trigger-free zone defined below the trigger moving zone and further that a mobile member is received in the grip portion, the mobile member being movable in the up-down direction in response to the crosswise sliding actuation of the stopper operating portion, the stopper portion provided on a top end of the mobile member and adapted to be protruded into or retracted from the trigger moving zone in response to the up-down movement of the mobile member, the mobile member provided at a bottom end with an insertion-coupling portion, the stopper operating portion having a slant guide groove whose inclination is such that the height of the slant guide groove is increased from one crosswise end to the other crosswise end, the insertion-coupling portion of the mobile member slidably inserted into the slant guide groove in such a manner that, upon crosswise sliding actuation of the stopper operating portion, the insertion-coupling portion can be moved in the up-down direction under the action of the slant guide groove. This makes it possible to convert the crosswise movement of the stopper operating portion to the up-down movement of the stopper portion with a simple construction.

It is also preferred that the power tool further includes an auxiliary spring for resiliently biasing the mobile member upwardly or downwardly to keep the stopper portion in the trigger-free zone or the trigger moving zone and a retaining member for retaining the stopper portion in at least one of the trigger-free zone and the trigger moving zone opposite from the zone in which the stopper portion is kept by the auxiliary spring. With this arrangement, the auxiliary spring helps the insertion-coupling portion to move smoothly along the slant guide groove, thus facilitating the movement of the mobile member and the stopper operating portion.

It is further preferred that the mobile member includes a protrusion-retraction portion adapted to be protruded into or retracted from the trigger moving zone in response to the movement of the mobile member, the stopper portion attached to the protrusion-retraction portion in such a manner that the position of the stopper portion can be adjusted in the moving direction of the trigger. With this arrangement, the position of the stopper portion can be adjusted in the moving direction of the trigger, thus making it possible to control the maximum pulling amount of the trigger and the maximum rotation speed of the motor, which depend on the position of the stopper portion.

It is further preferred that the stopper portion has an abutting surface that makes contact with the trigger and the trigger has an abutting surface that makes contact with the stopper portion, one of the abutting surfaces of the stopper portion and the trigger formed into a planar shape, the other abutting surface comprised of a plurality of abutting surfaces stepped along the moving direction of the trigger and arranged in the protrusion direction of the stopper portion. This allows the stopper portion or the trigger to make contact with arbitrary one of the plurality of abutting surfaces, thus making it possible to control in plural stages the maximum pulling amount of the trigger and the maximum rotation speed of the motor, which depend on the position of the stopper portion.

It is further preferred that the main body, the grip portion and the battery receiving portion cooperate to form a housing and further that the mobile member is received in the housing, the mobile member being movable in response to the crosswise sliding actuation of the stopper operating portion, the stopper portion provided on the mobile member and adapted to be protruded into or retracted from the trigger moving zone in response to the movement of the mobile member, the mobile member having a click-engaging section, the housing having a counter click-engaging section integrally formed therewith, the click-engaging section adapted to engage with the counter click-engaging section as the stopper portion moves into or out of the trigger moving zone. With this arrangement, due to the fact that the click-engaging section engages with the counter click-engaging section when the stopper portion is moved into or out of the trigger moving zone, the user can feel the stopper operating portion clicking in the actuation process thereof. Furthermore, the counter click-engaging section integrally formed with the housing eliminates the need to separately provide a click spring, thus making it possible to enjoy the click-feeling with a simple construction.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE PREFERRED EMBODIMENTS

Hereinbelow, the invention will be described with reference to the accompanying drawings in terms of exemplary embodiments. The power tool shown in FIGS. 1 through 6 is a rotary impact tool that can be used as a hand-held impact driver or a hand-held impact wrench.

Figure 1:
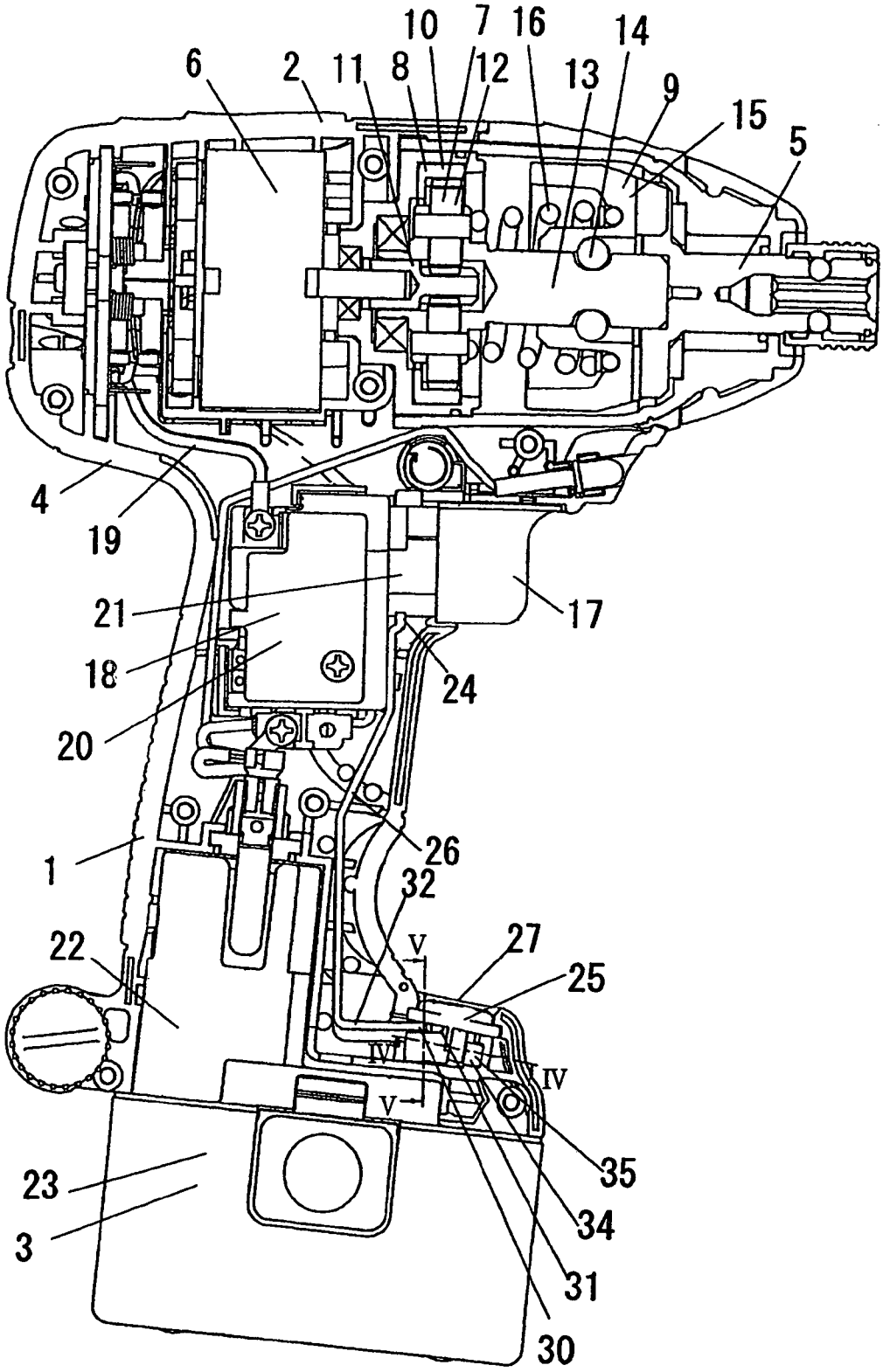
FIG. 1 is a side elevational cross-sectional view showing one embodiment of a power tool in accordance with the present invention, wherein a stopper portion is protruded into a trigger moving zone and a trigger is in a non-pulled condition.

Referring to FIG. 1, the power tool includes a generally round tubular hollow grip portion 1, a generally round tubular main body 2 provided at one axial end of the grip portion 1 with its axis intersecting the axis of the grip portion 1, and a battery receiving portion 3 provided at the other axial end of the grip portion 1 opposite to the main body 2. The respective outlines of the grip portion 1, the main body 2 and the battery receiving portion 3 cooperate with one another to form a housing 4. In the following description, the axial direction of the grip portion 1 will be referred to as "up-down" or "vertical", the axial end side of the grip portion 1 at which the main body 2 lies will be called "upper" or "top", and the direction perpendicular to the axis of the main body 2 as viewed from the top will be denoted as "crosswise".

The main body 2 provided at the upper end of the grip portion 1 has an axis that extends in a front-rear direction in a generally perpendicularly intersecting relationship with the axis of the grip portion 1 and is integrally connected to the upper end of the grip portion 1 at its axial middle portion. Thus, the grip portion 1 and the main body 2 have a generally T-shape as a whole when taking at a side view. Furthermore, the main body 2 has a greater outside dimension than that of the grip portion 1.

At one axial end of the main body 2 protruding from the grip portion 1, there is provided an output portion 5 to which a tool such as a driver bit, a socket or the like is attached in a removable manner. In this regard, the axial end side of the main body 2 at which the output portion 5 lies will be referred to as "front" and the opposite side will be called "rear".

The output portion 5 is rotated about the axis of the main body 2 by means of a motor 6 arranged at the rear part of the main body 2 and acting as a drive power source. The rotational driving force of the motor 6 is transmitted to the output portion 5 via a power transfer portion 7 provided in the main body 2.

The power transfer portion 7 is comprised of a speed reduction portion 8 connected at one end (rear end) to the motor 6 and an impact generation portion 9 operatively connected to the other end (front end) of the speed reduction portion 8. The rotational driving force of the motor 6 is transferred at a reduced speed to the output portion 5, which serves as an anvil, through the speed reduction portion 8 and the impact generation portion 9. If a load greater than a predetermined value is applied to the output portion 5, the impact generation portion 9 performs impact-applying motions in response to which a rotary driving force with a hammering action is transmitted to the output portion 5.

The speed reduction portion 8, which is constructed from a planetary reduction mechanism, includes a ring gear 10 fixedly secured to the inner surface of the main body 2, a sun gear 11 rotatably disposed at the center of the ring gear 10 and a plurality of planet gears 12 disposed to mesh with the internal teeth of the ring gear 10 and the external teeth of the sun gear 11. The revolution of the planet gears 12 is transmitted to a driving shaft 13 of the impact generation portion 9.

The impact generation portion 9 includes the driving shaft 13 rotatingly driven by the planet gears 12, a cam mechanism 14, a hammer 15 slidably coupled to the driving shaft 13 through the cam mechanism 14 for rotation with the driving shaft 13 as a unit, and a spring 16 for resiliently biasing the hammer 15 toward the output portion 5. If the load applied to the output portion 5 is equal to or smaller than the predetermined value, the hammer 15 rotatingly driven together with the driving shaft 13 is biased by the spring 16 into engagement with the output portion 5, thereby causing the output portion 5 to rotate as a unit. On the other hand, if the load applied to the output portion 5 exceeds the predetermined value in the process of driving a screw or conducting other tasks, the hammer 15 rotatingly driven together with the driving shaft 13 is slid toward the motor 6 under the action of the cam mechanism 14 and, subsequently, comes into hammering engagement with the output portion 5 by the restored force of the spring 16, thus applying rotational impact to the output portion 5. Repeating the series of impact-applying motions noted above ensures that the rotary driving force with the hammering action is transmitted to the output portion 5, which creates a strong tightening torque.

At the upper front surface of the grip portion 1 facing the same side as the output portion 5, a trigger 17 for, when pulled, causing rotation of the motor 6 is provided in such a fashion that it can be moved in a front-rear direction. Accommodated within the upper section of the grip portion 1 is a speed control switch 18 for controlling the rotation speed of the motor 6 in a stepless manner in proportion to the pulling amount of the trigger 17.

Figure 2:
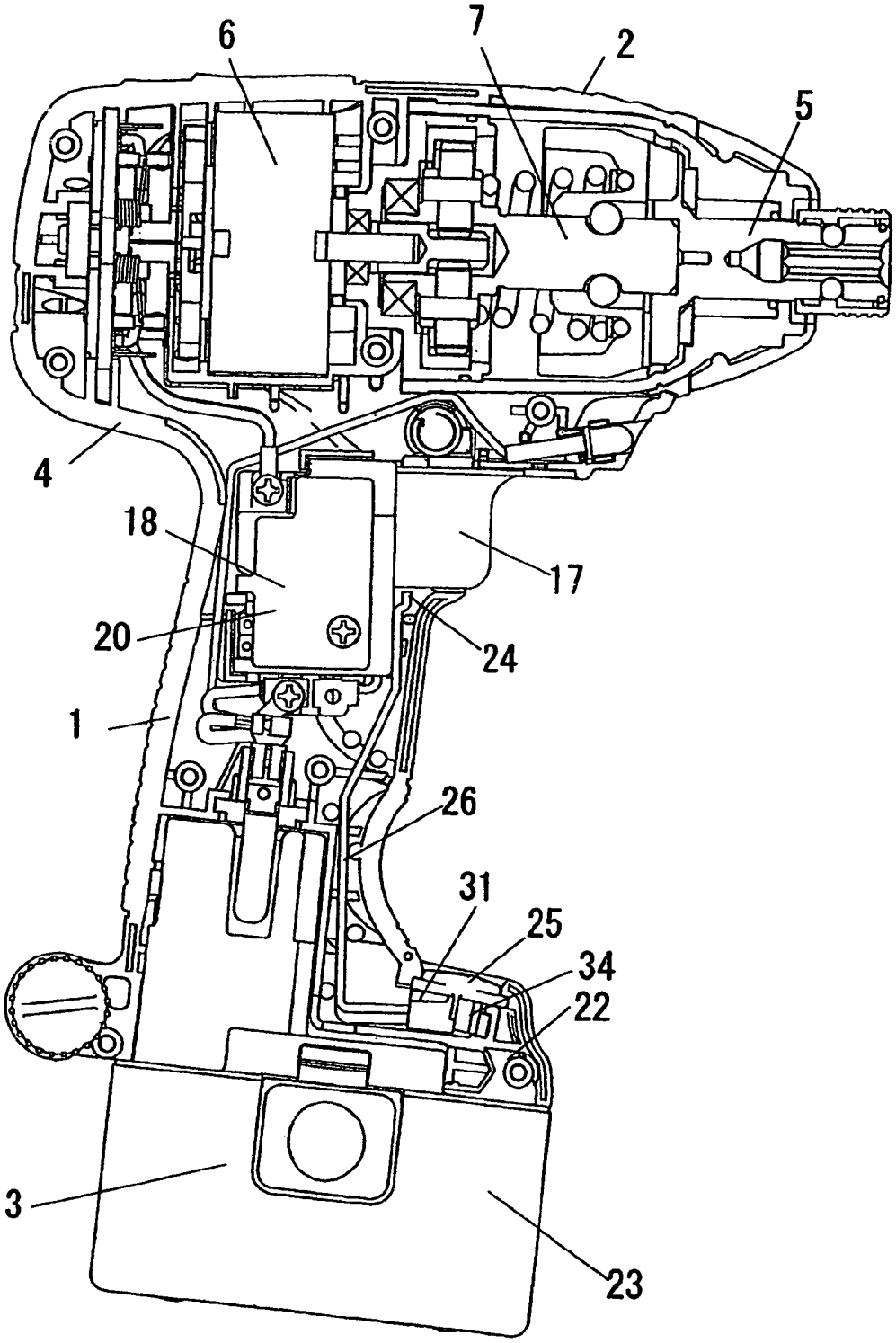
FIG. 2 is a side elevational cross-sectional view of the power tool shown in FIG. 1, wherein the stopper portion is retracted to a trigger-free zone and the trigger is pulled to a maximum extent.

The switch 18 includes a switch body 20 electrically connected to the motor 6 through a lead wire 19 and a switching portion 21 protruding frontward from the switch body 20 for movement in the front-rear direction. The trigger 17 is fixedly secured to the front end of the switching portion 21. The trigger 17 is movable in the front-rear direction within a range between a position in which the planar rear surface of the trigger 17 is spaced apart a predetermined distance from the front surface of the switch body 20 as shown in FIG. 1 and a position in which the planar rear surface of the trigger 17 is abutted to the front surface of the switch body 20 as depicted in FIG. 2. The amount by which the switching portion 21 is inserted into the switch body 20 can be adjusted by moving the trigger 17 within the afore-mentioned movement range. In response, the switch body 20 is electrically operated to change the rotation speed of the motor 6. The switch body 20 is so designed as to make sure that the motor 6 is not in rotation under the condition shown in FIG. 1 but spins at a maximum rotation speed under the state illustrated in FIG. 2.

The battery receiving portion 3 is adapted to receive a battery serving as a power source and includes a battery pack mounting section 22 integrally formed with the lower end of the grip portion 1 and a battery pack 23 detachably attached to the bottom surface of the battery pack mounting section 22. The battery contained in the battery pack 23 is electrically connected to the switch body 20 by way of battery terminals, which means that pulling operation of the trigger 17 allows electricity to be supplied to the motor 6 through the switch body 20. In this connection, the battery receiving portion 3 has an outside dimension greater than that of the grip portion 1. In other words, the front part and the crosswise side parts of the battery receiving portion 3 protrude outwardly farther than the grip portion 1 so that the top surface thereof can be in a confronting relationship with the main body 2.

A stopper portion 24 is received within the grip portion 1 for protrusion and retraction into and from a moving zone of the trigger 17. Protruding the stopper portion 24 into the trigger moving zone ensures that the stopper portion 24 makes contact with the trigger 17 thus limiting the maximum pulling amount of the trigger 17.

In accordance with the present invention, a stopper operating portion 25 for actuation of the stopper portion 24 is provided on the top surface of the battery receiving portion 3. Slidingly actuating the stopper operating portion 25 in the crosswise direction enables the stopper portion 24 to be protruded into or retracted from the trigger moving zone. The stopper portion 24 and the stopper operating portion 25 will be described in detail hereinbelow.

Figure 6:
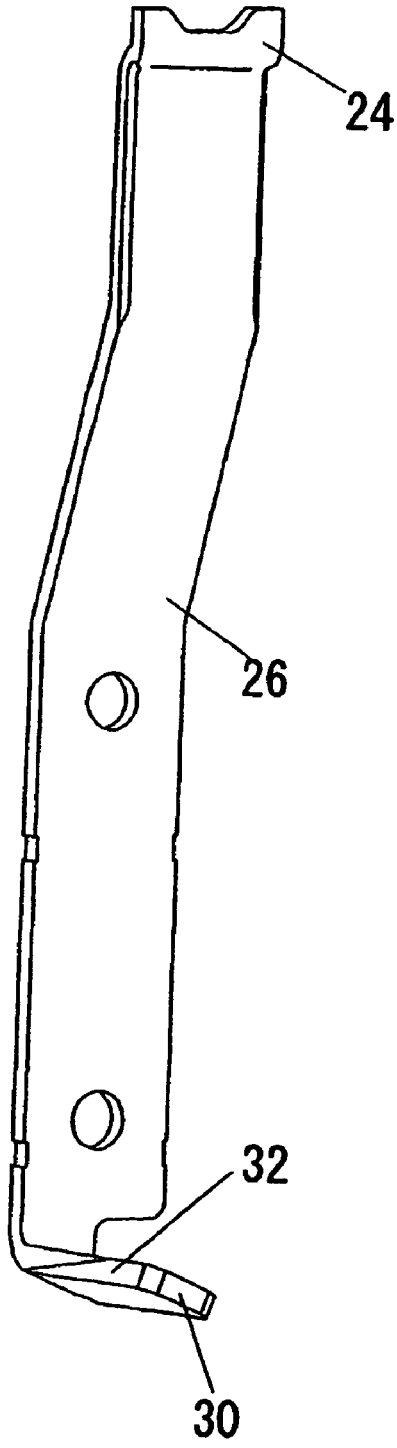
FIG. 6 is a perspective view illustrating a mobile member of the power tool shown in FIG. 1.

As shown in FIG. 6, the stopper portion 24 is formed on a generally vertically extending elongated mobile member 26 which in turn is received within the grip portion 1 for movement in an up-down direction. The mobile member 26 is disposed in the region between the grip portion 1 and the battery pack mounting section 22 of the battery receiving portion 3. Furthermore, the mobile member 26 is supported on the grip portion 1 and the battery pack mounting section 22 in such a fashion that it can be moved only in the up-down direction within a prescribed extent. The top end portion of the mobile member 26 plays a role of the stopper portion 24. The mobile member 26 is designed such that, as the mobile member 26 is moved in the up-down direction, the stopper portion 24 can be moved between the trigger moving zone and a trigger-free zone lying below the trigger moving zone. For instance, raising the mobile member 26 allows the stopper portion 24 to be protruded into the trigger moving zone.

The stopper operating portion 25 is arranged in a slide opening 27 formed on the top surface of the front part of the battery receiving portion 3 protruding frontward farther than the grip portion 1. As clearly shown in FIG. 5, the stopper operating portion 25 has a top surface acting as an operating surface and a pair of slide wings 28 extending outwardly in the crosswise direction at a position slightly lower than the top operating surface. The slide wings 28 are slidably inserted into slide grooves 29 formed at left and right sides around the slide opening 27, thus making the stopper operating portion 25 slidable in the crosswise direction. The slide grooves 29 are covered by a shroud section of the battery receiving portion 3 of the housing 4 so as to keep debris or dusts from infiltrating into the slide grooves 29. Furthermore, the stopper operating portion 25 is received in the slide opening 27 such that the top surface thereof is located at an elevation a little lower than the top surface of the battery receiving portion 3.

The stopper portion 24 is movable in the up-down direction in response to the crosswise sliding operation of the stopper operating portion 25. Provided between the stopper portion 24 and the stopper operating portion 25 is a motion converting mechanism for converting the crosswise movement of the stopper operating portion 25 to the up-down movement of the stopper portico 24.

The motion converting mechanism includes an insertion-coupling portion 30 provided at the lower end of the mobile member 26 and a slant guide groove 31 formed on the stopper operating portion 25. The insertion-coupling portion 30 is comprised of the tip end of a lug part 32, which is formed by bending the lower portion of the mobile member 26 frontward substantially at a right angle. The insertion-coupling portion 30 is in parallel with the direction to which the slant guide groove 31 extends. The slant guide groove 31 is formed on the rear surface of the bottom section of the stopper operating portion 25 protruding into the battery receiving portion 3. The inclination of the slant guide groove 31 is such that the height thereof is increased from one crosswise end to the other end (from the left end to the right end in the example illustrated). The insertion-coupling portion 30 is slidably inserted into the slant guide groove 31 from the rear side. This ensures that, upon actuation of the stopper operating portion 25 in the crosswise direction, the insertion-coupling portion 30 is moved in the up-down direction under the action of the slant guide groove 31. In other words, if the stopper operating portion 25 is caused to slide in the crosswise direction, the mobile member 26 having the insertion-coupling portion 30 and the stopper portion 24 is moved in the up-down direction, as a result of which the stopper portion 24 can be moved between the trigger moving zone and the trigger-free zone.

Figure 4:
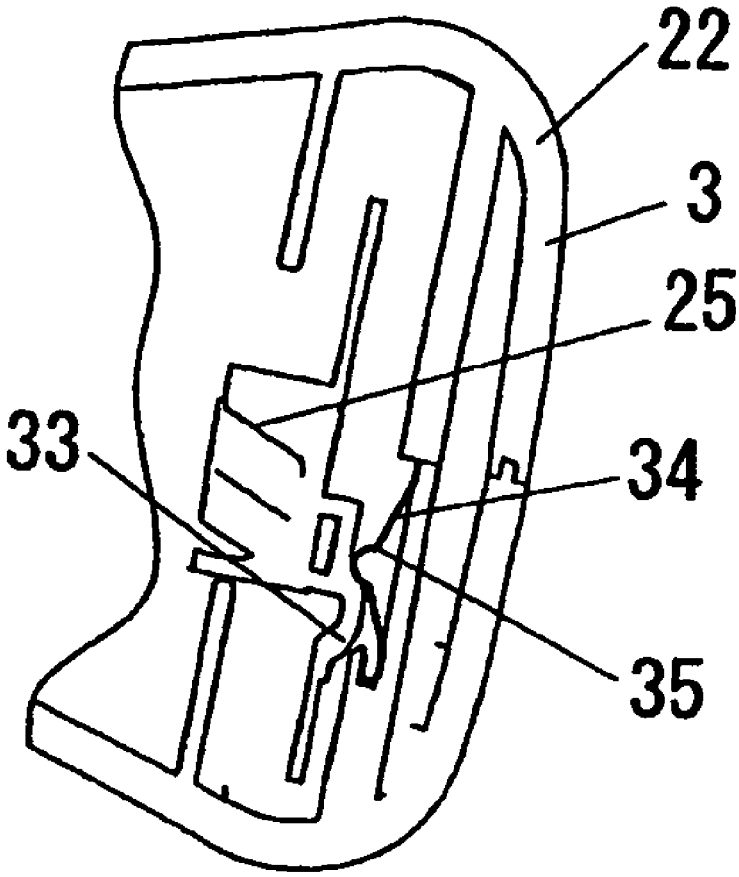
FIG. 4 is a cross-sectional view taken along line IV-IV of FIG. 1.
Figure 5:
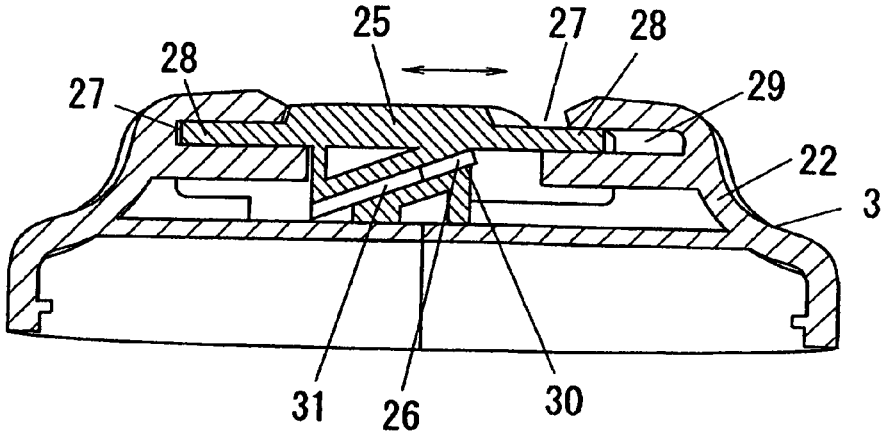
FIG. 5 is a cross-sectional view taken along line V-V of FIG. 1.

Referring to FIG. 4, a click-engaging section 33 protruding frontward is provided on the lower frontal surface of the stopper operating portion 25. The click-engaging section 33 is releasably engaged with a click spring 34 provided at the location inside the housing 4 facing the stopper operating portion 25 (specifically, on the front internal surface of the battery pack mounting section 22). The click spring 34 is bent into a generally chevron shape placed in sideways and has a ridge protruding toward the stopper operating portion 25. The ridge of the click spring 34 serves as a counter click-engaging section 35 with which the click-engaging section 33 of the stopper operating portion 25 engages. One side (the left side in the example illustrated) of the counter click-engaging section 35 comes into engagement with the click-engaging section 33, at the time when the stopper operating portion 25 is positioned at one crosswise end (the left end in the example illustrated) of the slide opening 27 and hence the stopper portion 24 is protruded into the trigger moving zone. The other side (the right side in the example illustrated) of the counter click-engaging section 35 is brought into engagement with the click-engaging section 33, at the time when the stopper operating portion 25 is positioned at the other crosswise end (the right end in the example illustrated) of the slide opening 27 and hence the stopper portion 24 is retracted to the trigger-free zone. As the stopper portion 24 is protruded from the trigger-free zone into the trigger moving zone or retracted in the opposite direction (namely, in the process of converting the maximum rotation speed of the motor 6), the click-engaging section 33 goes over the counter click-engaging section 35, in which process the user can feel clicking of the stopper operating portion 25. The stopper operating portion 25 is kept in place by the engagement of the click-engaging section 33 with the counter click-engaging section 35, thus maintaining the stopper portion 24 in one of the trigger-free zone and the trigger moving zone. In a nutshell, in accordance with this embodiment, the counter click-engaging section 35 of the click spring 34 acts as a means for retaining the stopper portion 24 in place.

In case where the power tool is used without limiting the maximum rotation speed of the motor 6, the stopper operating portion 25 is slid to one crosswise side (the right side in the example illustrated), thus lowering down the insertion-coupling portion 30 of the vertically movable mobile member 26 to the bottom end of the slant guide groove 31. This causes the click-engaging section 33 of the stopper operating portion 25 to engage with the counter click-engaging section 35. Concurrently, the stopper portion 24 of the mobile member 26 is retracted downwardly from the trigger moving zone to the trigger-free zone as illustrated in FIG. 2, thereby allowing the trigger 17 to move along the trigger moving zone above the stopper portion 24. This makes it possible for the user to pull the trigger 17 into the maximum pulling position as shown in FIG. 2, which means that no limit is imposed on the maximum rotation speed of the motor 6.

Figure 3:
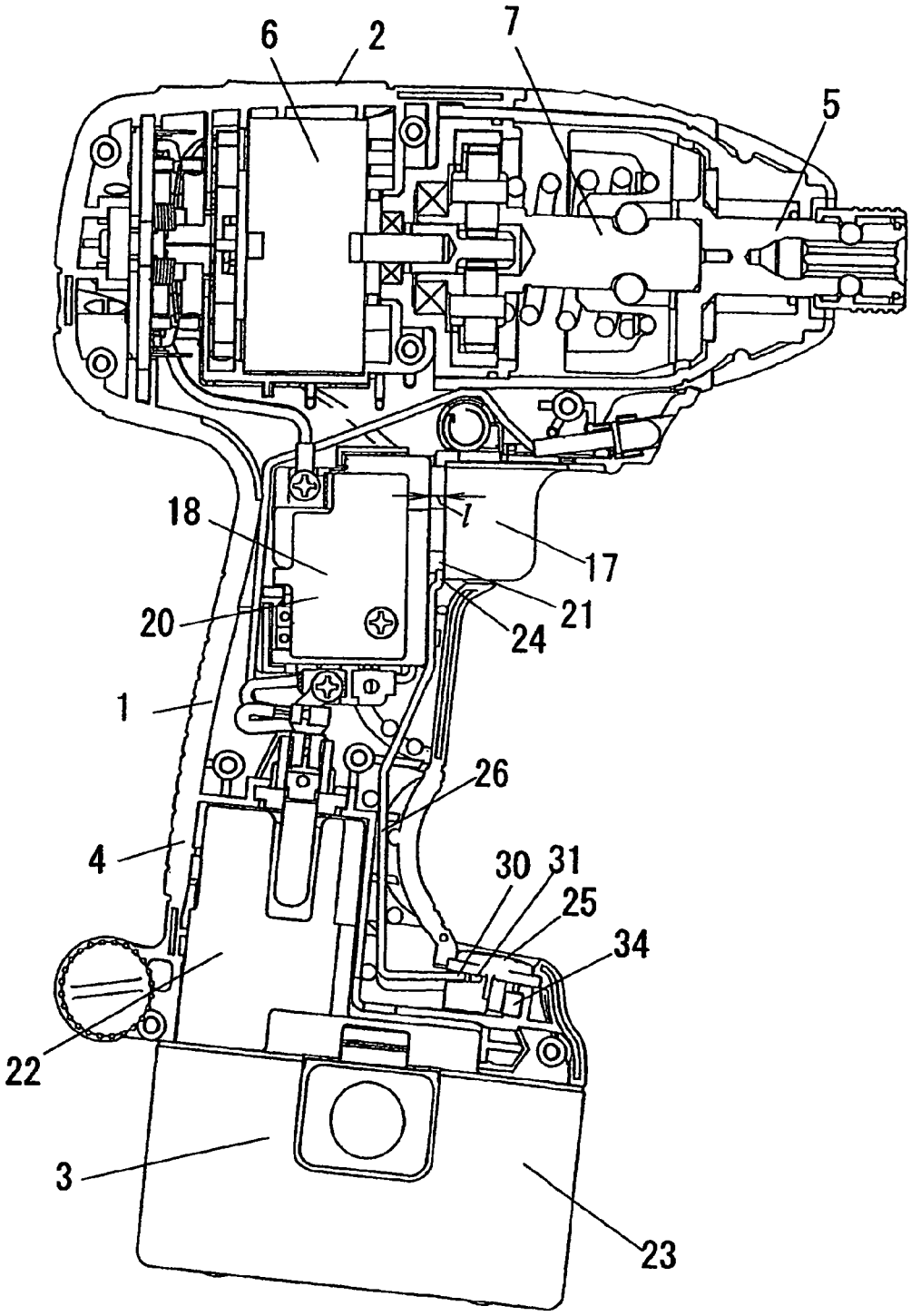
FIG. 3 is a side elevational cross-sectional view of the power tool, wherein the trigger is pulled from the condition shown in FIG. 1.

If the user wishes to limit the maximum rotation speed of the motor 6, the stopper operating portion 25 is slid to the other crosswise side (the left side in the example illustrated), thus lifting up the insertion-coupling portion 30 of the vertically movable mobile member 26 to the top end of the slant guide groove 31. This causes the click-engaging section 33 of the stopper operating portion 25 to engage with the counter click-engaging section 35. Concurrently, the stopper portion 24 of the mobile member 26 is protruded upwardly from the trigger-free zone into the trigger moving zone as illustrated in FIG. 1. Thus, at the time when the trigger 17 is pulled about halfway, the rear surface of the trigger 17 makes contact with the planar front surface of the stopper portion 24 protruded into the trigger moving zone as shown in FIG. 3, thereby making it unable to further pull the trigger 17. This limits the maximum pulling amount of the trigger 17 by the distance l ranging from the front surface of the switch body 20 to the front surface of the stopper portion 24, which means that the maximum rotation speed of the motor 6 is also limited. In other words, if the stopper portion 24 is positioned in the trigger moving zone through the actuation of the stopper operating portion 25, it becomes possible to keep low the maximum rotation speed of the motor 6 as compared to the case of the stopper portion 24 arranged in the trigger-free zone. This enables the user to mechanically change the maximum rotation speed of the motor 6 into two stages.

Once the maximum rotation speed of the motor 6 has been set in line with a target task through the actuation of the stopper operating portion 25 as set forth above, the user grasps the grip portion 1 of the power tool with the front surface of the trigger 17 reached by the index finger and then pulls the trigger 17 by use of the index finger to perform the target task while properly changing the pulling amount of the trigger 17 as desired.

As is apparent from the foregoing description, according to the present invention, the stopper operating portion 25 for actuation of the stopper portion 24 is provided on the top surface of the battery receiving portion 3 in a spaced-apart relationship with the grip portion 1. This makes it difficult for the user's fingers to inadvertently touch the stopper operating portion 25 when the grip portion 1 is initially grasped or continues to be in a grasped condition. Furthermore, the top surface of the battery receiving portion 3 on which the stopper operating portion 25 is provided is so oriented as to face the main body 2. Thus, it is hard for the stopper operating portion 25 to make contact with a tool resting surface even if the power tool is placed on the tool resting surface when not in use. This helps to avoid any erroneous actuation of the stopper operating portion 25. Moreover, even when the power tool is dropped on a floor inadvertently, the stopper operating portion 25 can hardly make contact with the floor and thus the stopper operating portion 25 is prevented from any damage. There may be a concern that, when a user with large hands strongly pulls the trigger 17 or grasps the grip portion 1 with an increased force, the stopper operating portion 25 can be unintentionally touched and erroneously actuated by the little finger of the user's hand grasping the grip portion 1. However, such erroneous actuation can be avoided in the present invention because the stopper operating portion 25 is slidingly actuated in the crosswise direction. More concretely, when firmly grasping the grip portion, the little finger of the user's hand moves in the front-rear direction and not in the crosswise direction in which the stopper operating portion 25 is actuated. For this reason, the stopper operating portion 25 is kept stationary even in a hypothetical case that the user's hand makes contact with the stopper operating portion 25 during the course of its movement in the front-rear direction. This prevents the stopper operating portion 25 from being erroneously actuated, by the little finger of the user's hand.

Figure 7:
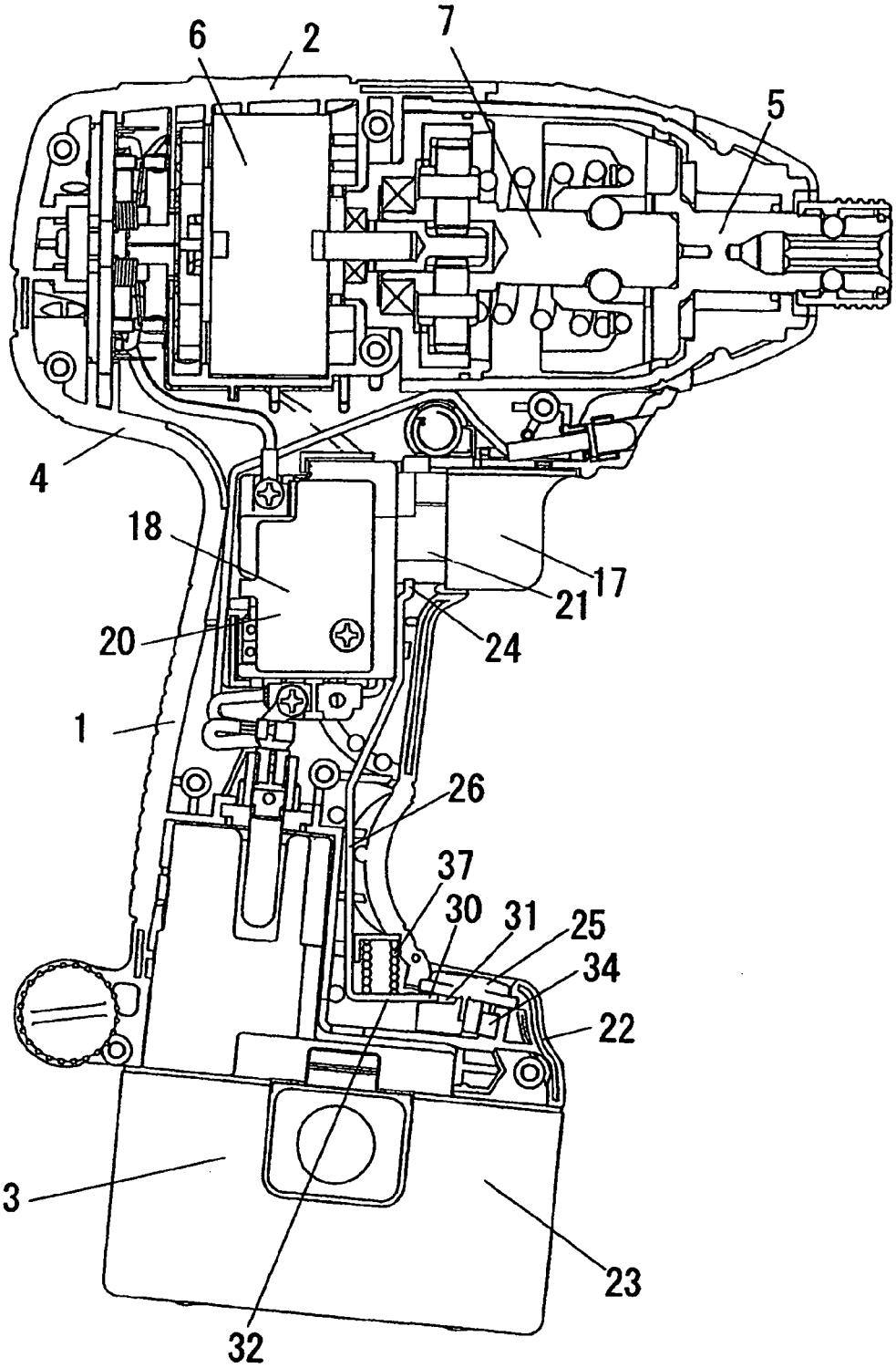
FIG. 7 is a side elevational cross-sectional view showing another embodiment of a power tool in accordance with the present invention, wherein a stopper portion is protruded into a trigger moving zone and a trigger is in a non-pulled condition.
Figure 8:
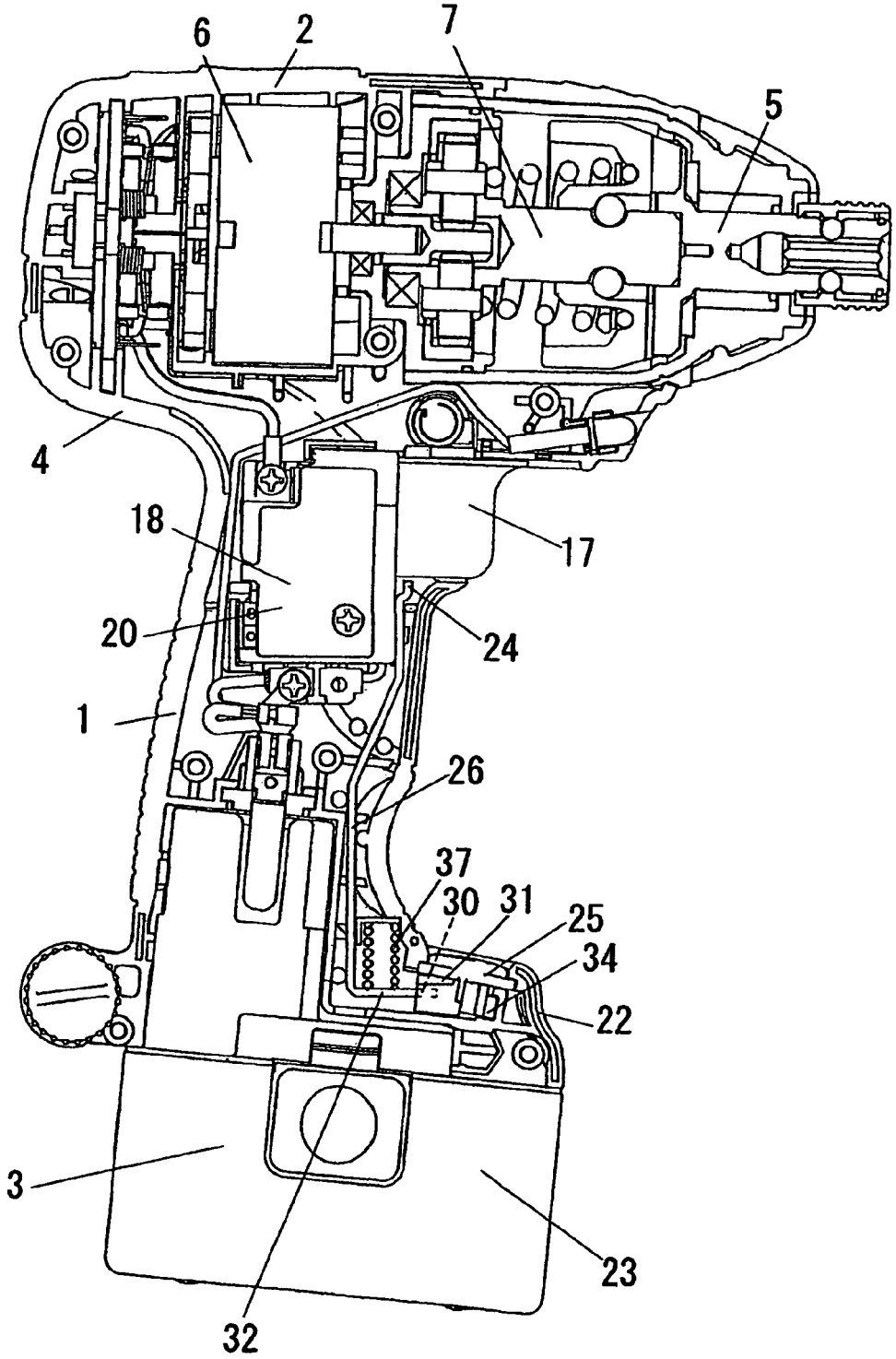
FIG. 8 is a side elevational cross-sectional view of the power tool shown in FIG. 7, wherein the stopper portion is retracted to a trigger-free zone and the trigger is pulled to a maximum extent.

Next, description will be given to another embodiment of the present invention shown in FIGS. 7 and 8. The same components as illustrated in FIG. 1 are designated by like reference numerals, with no duplicate description offered in that regard.

In accordance with this embodiment, the power tool includes an auxiliary spring 37 for resiliently biasing the mobile member 26 upwardly or downwardly to keep the stopper portion 24 in the trigger-free zone or the trigger moving zone and a member for retaining the stopper portion 24 in at least one of the trigger-free zone and the trigger moving zone different from the zone into which the stopper portion 24 is kept by the auxiliary spring 37. In the example illustrated, the auxiliary spring 37 is disposed between the upper surface of the lug part 32 provided at the bottom end of the mobile member 26 and the internal surface of the housing 4 facing the upper surface of the lug part 32. The auxiliary spring 37 serves to resiliently bias the mobile member 26 in a downward direction, thus keeping the stopper portion 24 in the trigger-free zone as depicted in FIG. 8. As in the embodiment shown in FIG. 1, the stopper portion 24 is retained in one of the trigger-free zone and the trigger moving zone by allowing the click-engaging section 33 to engage with the counter click-engaging section 35. In this way, the power tool of this embodiment is provided with the auxiliary spring 37 for resiliently biasing the mobile member 26 upwardly or downwardly to bring the stopper portion 24 into the trigger-free zone or the trigger moving zone. The auxiliary spring 37 helps the insertion-coupling portion 30 to move smoothly along the slant guide groove 31, thus facilitating the movement of the mobile member 26 and the stopper operating portion 25.

Figure 9:
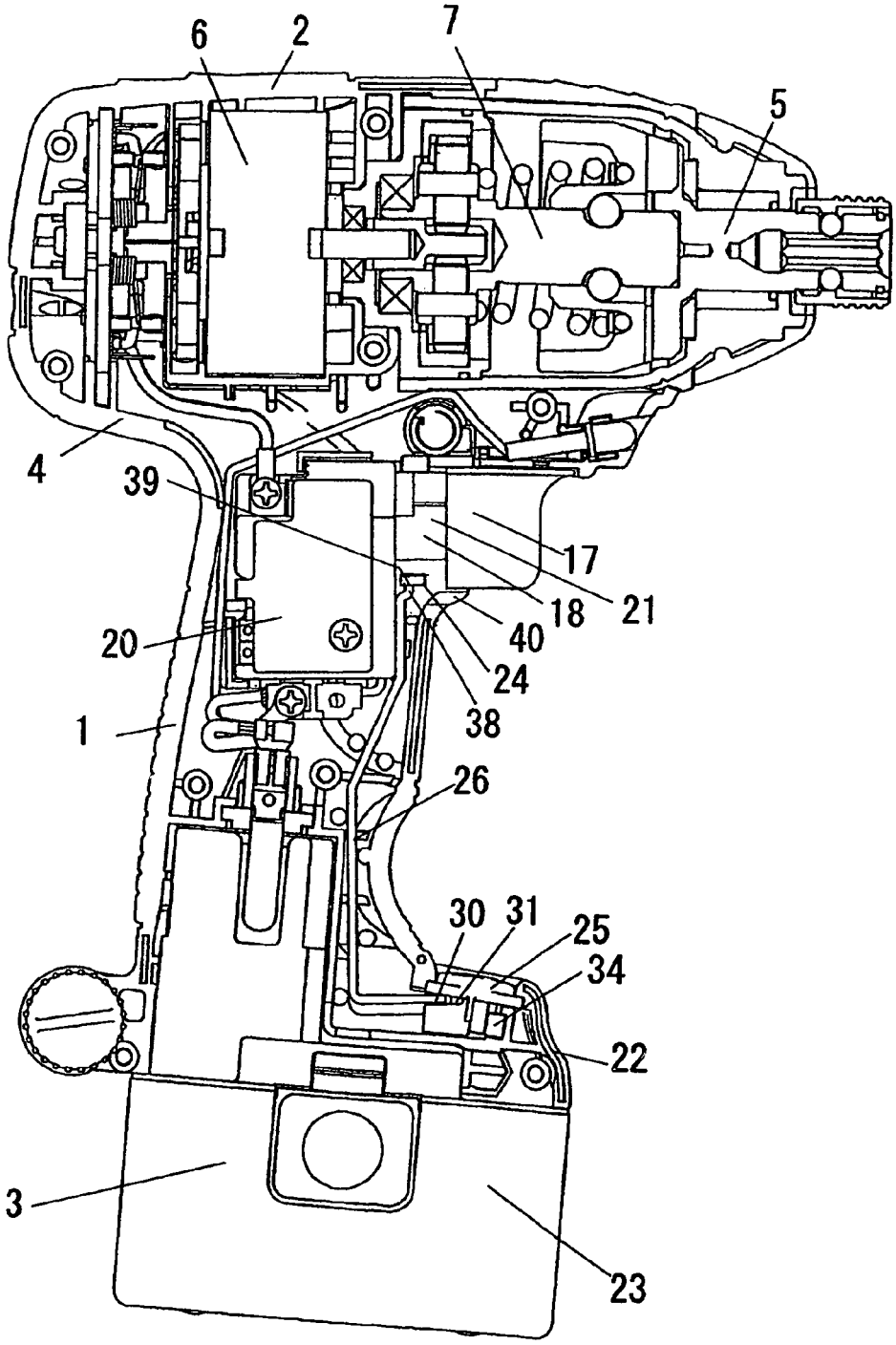
FIG. 9 is a side elevational cross-sectional view showing a further embodiment of a power tool in accordance with the present invention, wherein a protrusion-retraction portion and a stopper portion are placed in a trigger moving zone and a trigger is in a non-pulled condition.
Figures 10A, 10B:
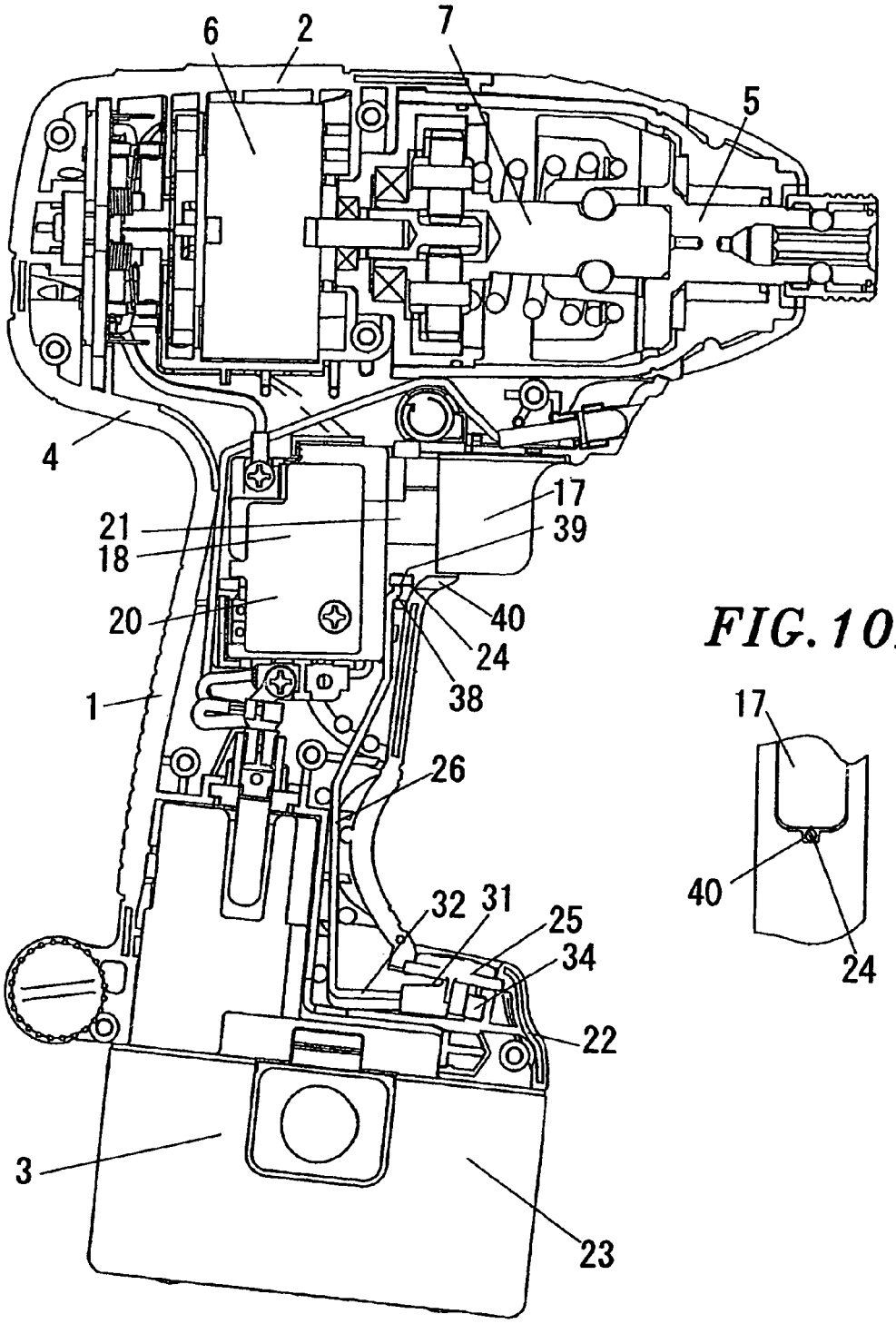
FIG. 10A is a side elevational cross-sectional view of the power tool shown in FIG. 9, wherein the protrusion-retraction portion and the stopper portion are placed in a trigger-free zone and the trigger is in a non-pulled condition
FIG. 10B is a font view showing one major part of the power tool.
Figure 11:
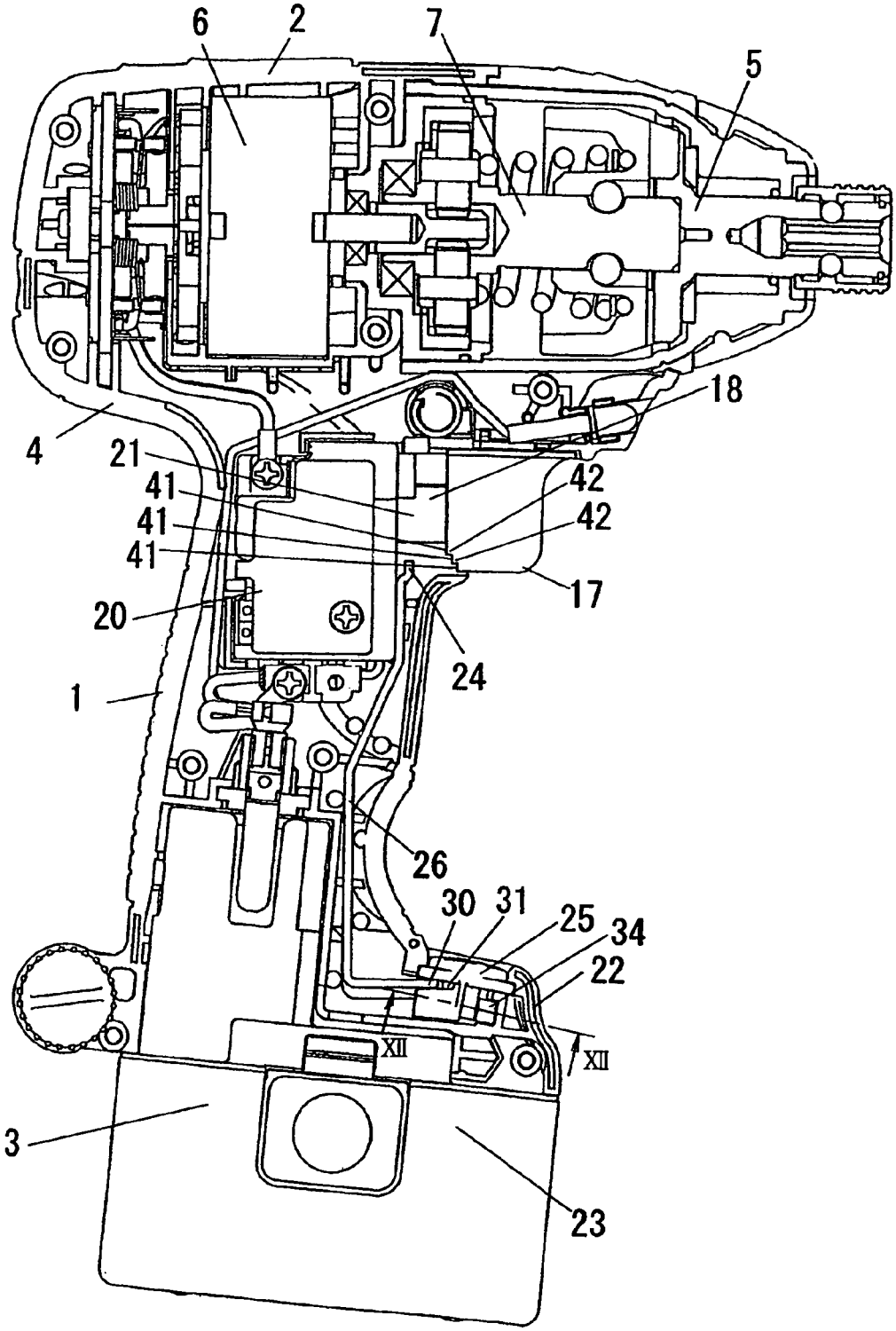
FIG. 11 is a side elevational cross-sectional view showing a still further embodiment of a power tool in accordance with the present invention, wherein a stopper portion is protruded into a moving zone of a second-lowermost abutting surface of a trigger and the trigger is in a non-pulled condition.

Next, description will be given to a further embodiment of the present invention shown in FIGS. 9 to 10B. The same components as illustrated in FIG. 1 are designated by like reference numerals, with no duplicate description offered in that regard.

In accordance with this embodiment, the mobile member 26 includes a protrusion-retraction portion 38 that can be protruded into or retracted from the trigger moving zone in response to the movement of the mobile member 26. The stopper portion 24 whose position is adjustable in the moving direction of the trigger 17 is attached to the protrusion-retraction portion 38. In the example illustrated, the top end of the mobile member 26 plays a role of the protrusion-retraction portion 38. The stopper portion 24 has at its circumferential surface a male thread section threadedly coupled to a female thread hole 39 formed through the protrusion-retraction portion 38 in the moving direction of the trigger 17. Thus, the stopper portion 24 is attached to the protrusion-retraction portion 38 in such a manner that the former protrudes frontward from the latter. At the frontal top area of the grip portion 1 facing the stopper portion 24 positioned in the trigger-free zone (namely, at the area directly below the trigger 17), an access opening 40 for tool insertion is formed in the front-rear direction. Through the access opening 40, a tool such as a screw driver or the like stored in the grip portion 1 can be inserted into the grip portion 1 toward the front operating surface of the stopper portion 24 to rotatingly drive the stopper portion 24 kept in the trigger-free zone. Accordingly, in this embodiment, the tightening amount in which the stopper portion 24 is driven into the female thread hole 39 can be adjusted by turning the stopper portion 24 with the tool. This makes it possible to adjust the overhang amount in which the stopper portion 24 projects frontward from the protrusion-retraction portion 38, whereby the position of the stopper portion 24 in the moving direction of the trigger 17 can be adjusted in a stepless manner. As a consequence, it becomes possible to finely control the maximum pulling amount of the trigger 17 and hence the maximum rotation speed of the motor 6. It should be appreciated that this embodiment may be applied to the embodiment shown in FIG. 7.

Next, description will be given to a still further embodiment of the present invention shown in FIGS. 11 through 14. The same components as illustrated in FIG. 1 are designated by like reference numerals, with no duplicate description offered in that regard.

Figure 12:
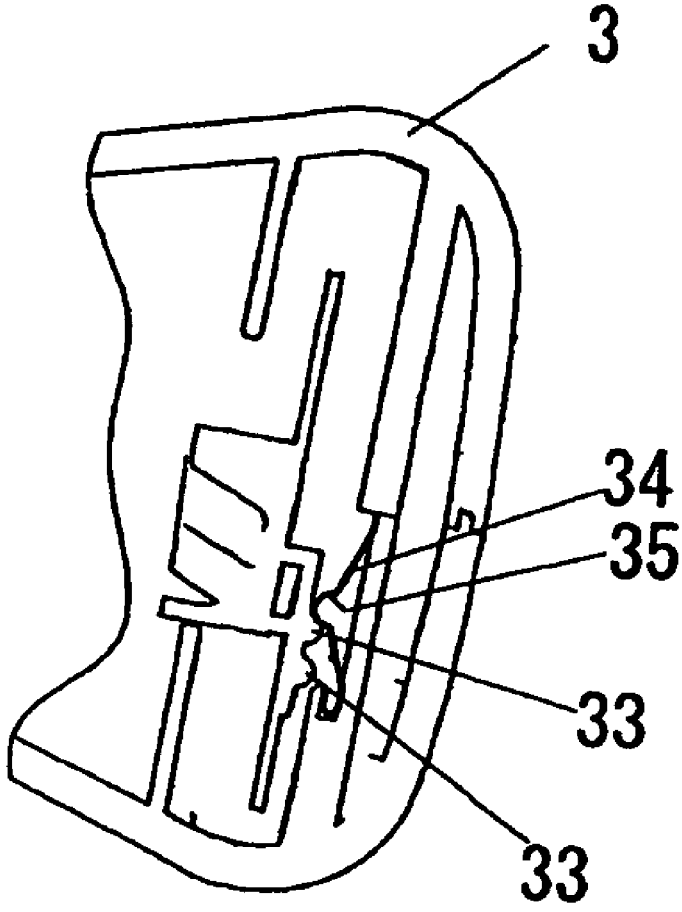
FIG. 12 is a cross-sectional view taken along line XII-XII of FIG. 11.
Figure 13:
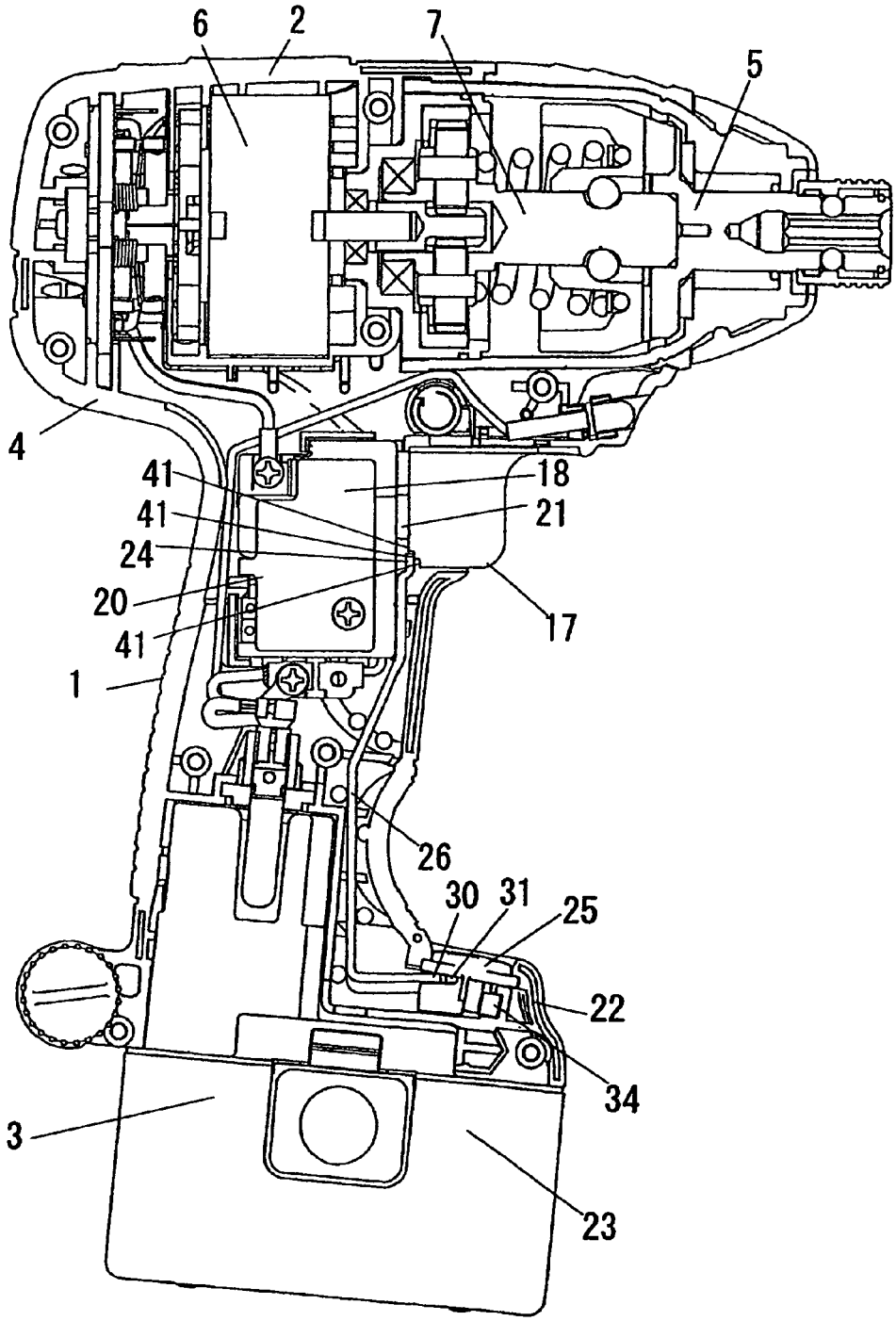
FIG. 13 is a side elevational cross-sectional view of the power tool, wherein the trigger is pulled from the condition shown in FIG. 11.
Figure 14:
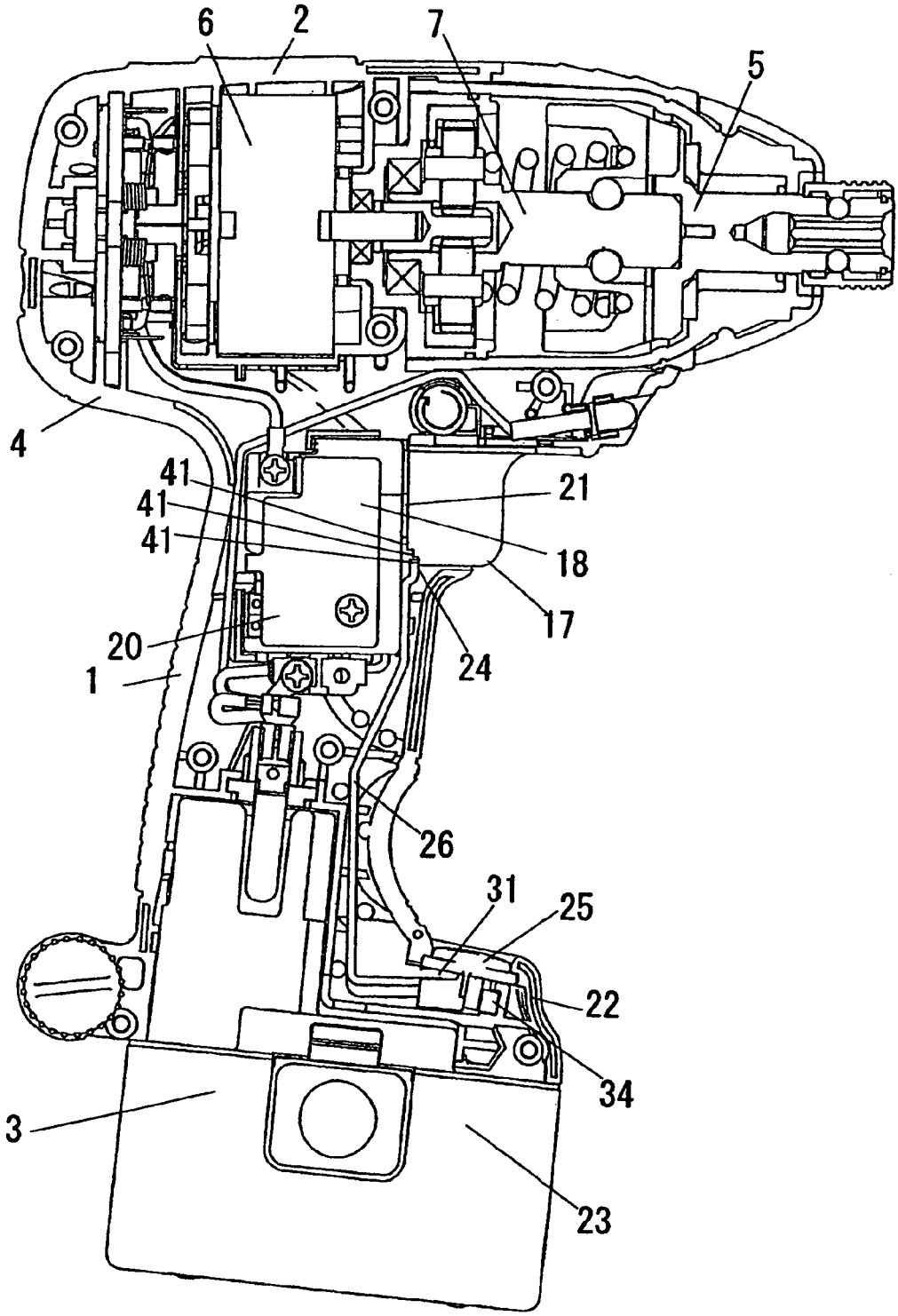
FIG. 14 is a side elevational cross-sectional view of the power tool shown in FIG. 11, wherein the stopper portion is protruded into a moving zone of a lowermost abutting surface of a trigger and the trigger is in a pulled condition.

In accordance with this embodiment, one of the abutting surface of the stopper portion 24 that makes contact with the trigger 17 and the abutting surface of the trigger 17 that makes contact with the stopper portion 24 is formed into a planar shape, while the other abutting surface is comprised of a plurality of abutting surfaces 41 stepped along the moving direction of the trigger 17 and arranged in the protrusion direction of the stopper portion 24. In the example illustrated, the abutting surface of the stopper portion 24 that makes contact with the trigger 17 is formed of a planar surface, and a plurality of abutting surfaces 41 stepped along the moving direction of the trigger 17 is provided in the protrusion-retraction direction of the stopper portion 24, as the abutting surface of the trigger 17 that makes contact with the stopper portion 24. The abutting surfaces 41 stepped along the moving direction of the trigger 17 are formed by providing plural numbers of (two, in the example illustrated) frontwardly recessed steps 42 on the rear lower surface area of the trigger 17 in a stairway shape. In other words, the abutting surfaces 41 are formed in the number equal to the number of the steps 42 plus one and arranged in such a fashion that the lower they are located, the more frontward they lie. As can be seen in FIG. 12, the click-engaging sections 33 whose number corresponds to the number of the steps 42 (two, in the example illustrated) are formed on the stopper operating portion 25 side by side in the crosswise direction. Bringing each of the click-engaging sections 33 into engagement with the counter click-engaging section 35 makes it possible to retain the stopper operating portion 25 in one of plural slide positions so that the stopper portion 24 can make contact with one of the abutting surfaces 41 selected thereof. This means that, in this embodiment, the protrusion amount of which the stopper portion 24 is protruded into the trigger moving zone can be adjusted in plural stages as illustrated in FIGS. 13 and 14 by slidingly actuating the stopper operating portion 25 in the crosswise direction. Accordingly, it is possible to have the stopper portion 24 make contact with arbitrary one of the abutting surfaces 41 of the trigger 17, thereby adjusting the maximum pulling amount of the trigger 17 in plural stages. It should be appreciated that this embodiment may be applied to the embodiment shown in FIG. 7.

Figure 15:
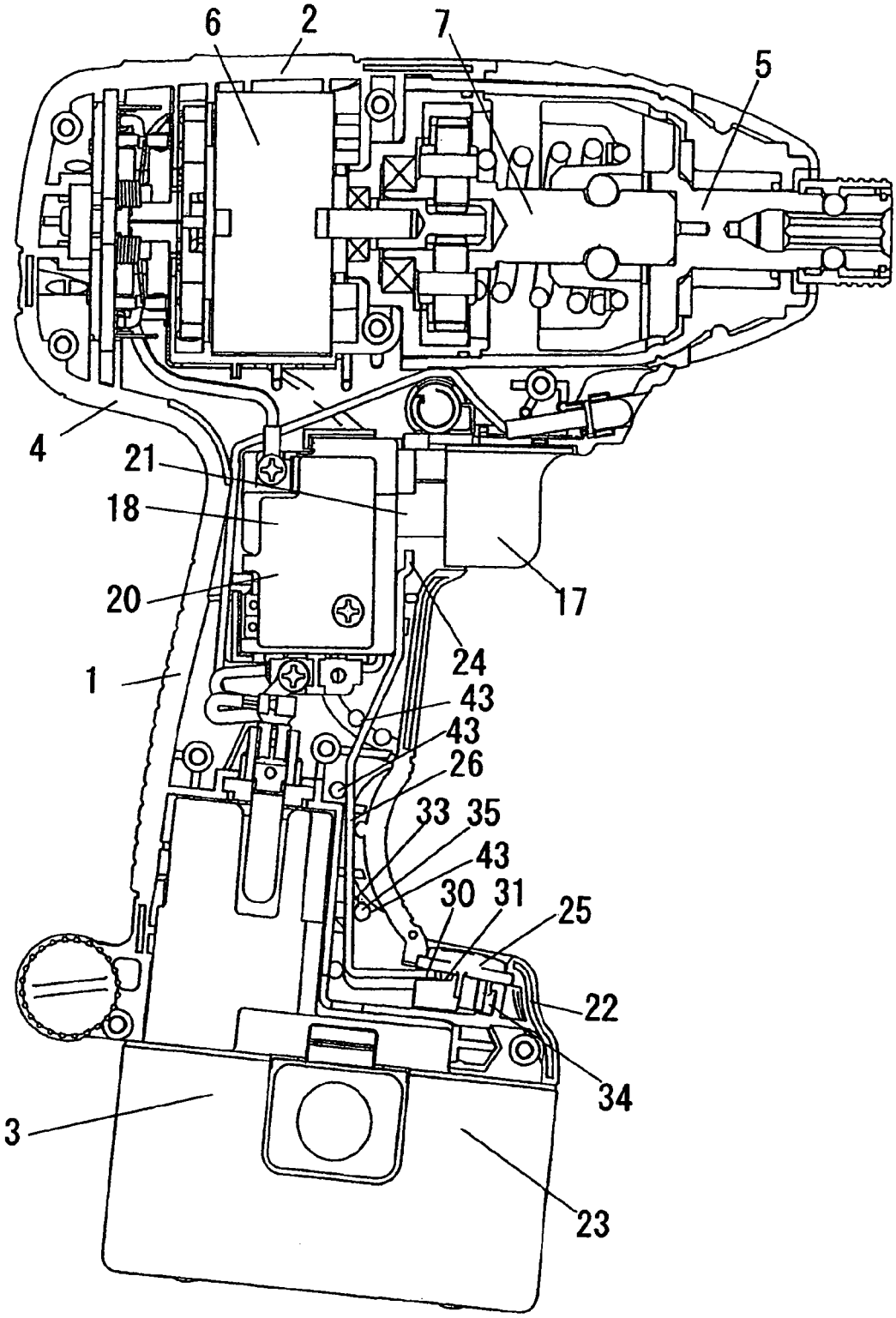
FIG. 15 is a side elevational cross-sectional view showing a yet still further embodiment of a power tool, wherein a stopper portion is protruded into a trigger moving zone and a trigger is in a non-pulled condition.
Figure 16:
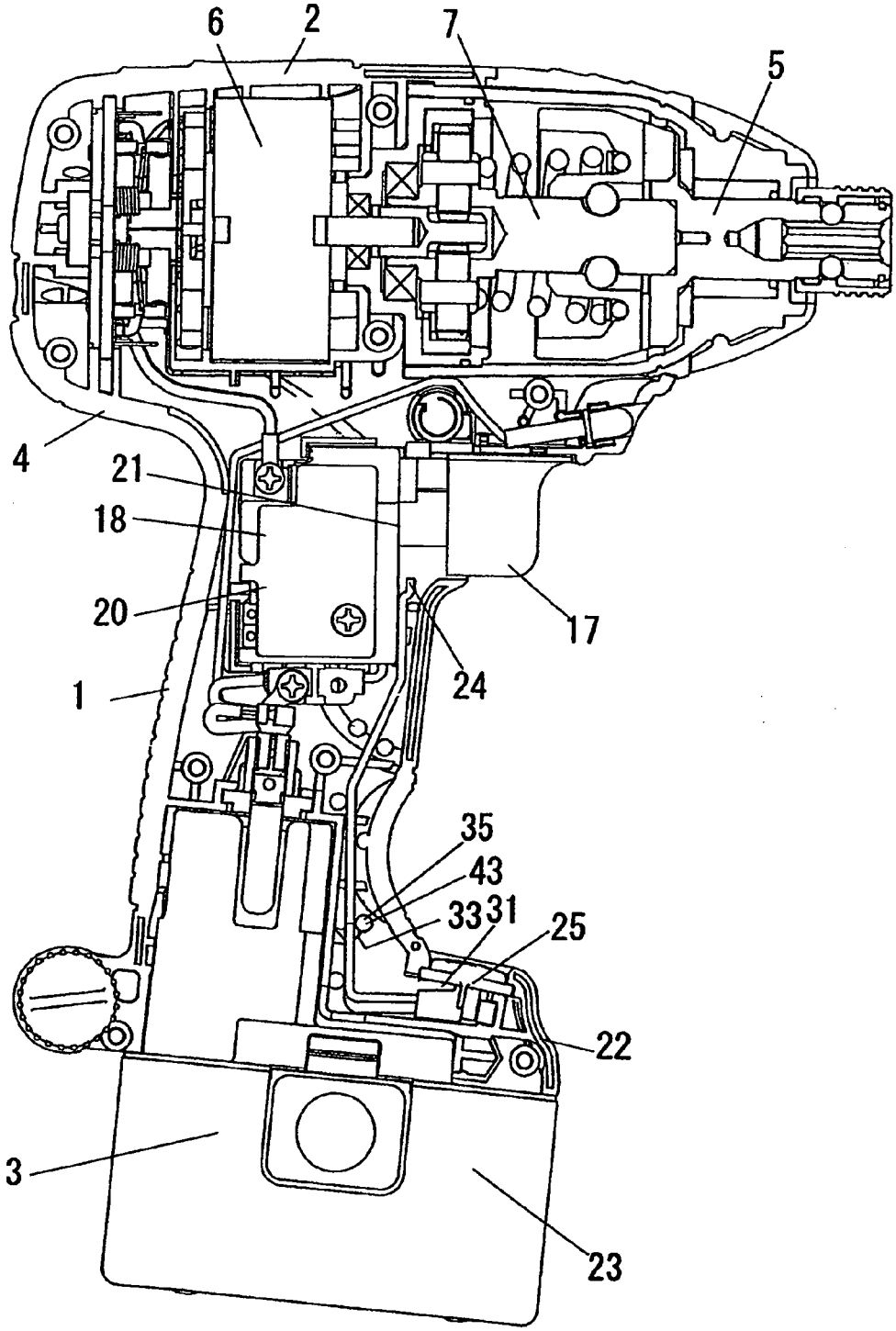
FIG. 16 is a side elevational cross-sectional view of the power tool shown in FIG. 15, wherein the stopper portion is retracted to a trigger-free zone and the trigger remains in the non-pulled condition.

Next, description will be given to a yet still further embodiment of the present invention shown in FIGS. 15 and 16. The same components as illustrated in FIG. 1 are designated by like reference numerals, with no duplicate description offered in that regard.

In accordance with this embodiment, the click-engaging section 33 is provided on the mobile member 26 and the counter click-engaging section 35 is integrally formed with the housing 4. In the example illustrated, the click-engaging section 33 is adapted to protrude frontward from the lower end of the mobile member 26. Furthermore, the counter click-engaging section 35 is comprised of arbitrary one of round bosses 43 that are provided within the housing 4 to support the mobile member 26 in a vertically movable manner. Accordingly, in this embodiment, the stopper portion 24 can be retained in one of the trigger moving zone and the trigger-free zone by bringing the click-engaging section 33 integrally formed with the mobile member 26 into engagement with the counter click-engaging section 35 forming a part of the housing 4. In addition, the user can feel the stopper operating portion 25 clicking in the actuation process thereof. This eliminates the need to separately provide the click spring 34 set forth earlier in respect of the embodiment shown in FIG. 1, thus structurally simplifying the retainer member and the click-feeling generator. It should be appreciated that this embodiment may be applied to the embodiments shown in FIGS. 7, 9 and 11.

What is claimed is:

1. A power tool comprising:

a grip portion having an axis extending in an up-down direction;

a main body provided at a top end of the grip portion and having an axis intersecting the axis of the grip portion;

a motor for generating a rotational force;

an output portion provided at one axial end of the main body projecting from the grip portion and rotatingly driven by the motor;

a trigger provided on an upper output-portion-side surface of the grip portion for movement along a trigger moving zone;

a speed control switch received within the grip portion, for controlling the rotation speed of the motor in proportion to the pulling amount of the trigger;

a stopper portion accommodated in the grip portion for protrusion and retraction into and from the trigger moving zone, the stopper portion adapted to, when protruded into the trigger moving zone, make contact with the trigger to thereby limit the maximum pulling amount of the trigger;

a battery receiving portion provided at a bottom end of the grip portion and having an outside dimension greater than that of the grip portion;

a stopper operating portion provided on a top surface of the battery receiving portion for operating the stopper portion, wherein the stopper portion is protruded into or retracted from the trigger moving zone by slidingly actuating the stopper operating portion in a crosswise direction perpendicularly intersecting the axis of the main body as viewed from the top; and a mobile member received in the grip portion, the mobile member being movable in the up-down direction in response to the crosswise sliding actuation of the stopper operating portion, wherein, upon actuation of the stopper operating portion in the crosswise direction, the stopper portion is moved in the up-down direction between the trigger moving zone and a trigger-free zone defined below the trigger moving zone and is provided on a top end of the mobile member and adapted to be protruded into or retracted from the trigger moving zone in response to the up-down movement of the mobile member; the mobile member is provided at a bottom end with an insertion-coupling portion;

wherein the stopper operating portion has a slant guide groove whose inclination is such that the height of the slant guide groove is increased from one crosswise end to the other crosswise end; and wherein the insertion-coupling portion of the mobile member is slidably inserted into the slant guide groove in such a manner that, upon crosswise sliding actuation of the stopper operating portion, the insertion-coupling portion is moved in the up-down direction under the action of the slant guide groove.

2. The power tool of claim 1, further comprising an auxiliary spring for resiliently biasing the mobile member upwardly or downwardly to keep the stopper portion in the trigger-free zone or the trigger moving zone and a retaining member for retaining the stopper portion in at least one of the trigger-free zone and the trigger moving zone opposite from the zone in which the stopper portion is kept by the auxiliary spring.

3. The power tool of claim 2, wherein the mobile member includes a protrusion-retraction portion adapted to be protruded into or retracted from the trigger moving zone in response to the movement of the mobile member, and the stopper portion is attached to the protrusion-retraction portion in such a manner that the position of the stopper portion is adjusted in the moving direction of the trigger.

4. The power tool of claim 2, further comprising a housing formed by the respective outlines of the main body, the grip portion and the battery receiving portion, wherein the mobile member is received in the housing, the mobile member being movable in response to the crosswise sliding actuation of the stopper operating portion and having a click-engaging section; the housing has a counter click-engaging section integrally formed therewith; the stopper portion is provided on the mobile member and is adapted to be protruded into or retracted from the trigger moving zone in response to the movement of the mobile member; and the click-engaging section is adapted to engage with the counter click-engaging section as the stopper portion moves into or out of the trigger moving zone.

5. The power tool of claim 1, wherein the mobile member includes a protrusion-retraction portion adapted to be protruded into or retracted from the trigger moving zone in response to the movement of the mobile member, and the stopper portion is attached to the protrusion-retraction portion in such a manner that the position of the stopper portion is adjusted in the moving direction of the trigger.

6. The power tool of claim 1, wherein the stopper portion has an abutting surface that makes contact with the trigger and the trigger has an abutting surface that makes contact with the stopper portion, one of the abutting surfaces of the stopper portion and the trigger being formed into a planar shape, the other abutting surface being comprised of a plurality of abutting surfaces stepped along the moving direction of the trigger and arranged in the protrusion direction of the stopper portion.

7. The power tool of claim 1, further comprising a housing formed by the respective outlines of the main body, the grip portion and the battery receiving portion, wherein the mobile member is received in the housing, the mobile member being movable in response to the crosswise sliding actuation of the stopper operating portion and having a click-engaging section; the housing has a counter click-engaging section integrally formed therewith; the stopper portion is provided on the mobile member and is adapted to be protruded into or retracted from the trigger moving zone in response to the movement of the mobile member; and the click-engaging section is adapted to engage with the counter click-engaging section as the stopper portion moves into or out of the trigger moving zone.

* * * * *